US010897683B2

(12) United States Patent
Laitinen et al.

(10) Patent No.: US 10,897,683 B2
(45) Date of Patent: Jan. 19, 2021

(54) APPARATUS, METHOD AND COMPUTER PROGRAM FOR PROVIDING SOUND REPRODUCTION

(71) Applicant: Nokia Technologies Oy, Espoo (FI)

(72) Inventors: Mikko-Ville Laitinen, Helsinki (FI); Miikka Vilermo, Siuro (FI); Mikko Tammi, Tampere (FI)

(73) Assignee: Nokia Technologies Oy, Espoo (FI)

( * ) Notice: Subject to any disclaimer, the term of this patent is extended or adjusted under 35 U.S.C. 154(b) by 41 days.

(21) Appl. No.: 15/742,648

(22) PCT Filed: Jul. 5, 2016

(86) PCT No.: PCT/FI2016/050491
§ 371 (c)(1),
(2) Date: Jan. 8, 2018

(87) PCT Pub. No.: WO2017/005975
PCT Pub. Date: Jan. 12, 2017

(65) Prior Publication Data

US 2018/0206054 A1 Jul. 19, 2018

(30) Foreign Application Priority Data

Jul. 9, 2015 (GB) ..... 1512046.2

(51) Int. Cl.
*H04S 7/00* (2006.01)
*H04R 1/40* (2006.01)
*H04R 3/00* (2006.01)

(52) U.S. Cl.
CPC ..... *H04S 7/303* (2013.01); *H04R 1/406* (2013.01); *H04R 3/005* (2013.01);
(Continued)

(58) Field of Classification Search
CPC combination set(s) only.
See application file for complete search history.

(56) References Cited

U.S. PATENT DOCUMENTS 5,734,724 A * 3/1998 Kinoshita ..... H04M 3/56 370/265
6,498,857 B1 * 12/2002 Sibbald ..... H04S 7/30 381/1

(Continued)

FOREIGN PATENT DOCUMENTS

CN 104604257 A 5/2015
EP 1995993 A1 11/2008

(Continued)

*Primary Examiner* — Duc Nguyen
*Assistant Examiner* — Assad Mohammed
(74) *Attorney, Agent, or Firm* — Harrington & Smith

(57) ABSTRACT

A method, apparatus and computer program wherein the method includes: obtaining at least three ambient audio signals wherein at least one of the ambient audio signals is to be processed with a first directional transfer function pair and at least one other of the ambient audio signals is to be processed with a second directional transfer function pair wherein the directional transfer function pairs to be used are based on target directions of the ambient audio signals; determining a change of the target direction for the at least one ambient audio signal to an updated target direction; selecting an updated directional transfer function pair associated with the updated target direction wherein the updated directional transfer function pair is selected from a plurality of directional transfer functions and the updated directional transfer function pair is more closely associated with the updated target direction than the first directional transfer function pair; and processing the at least one ambient audio signal with the selected updated directional transfer function pair and processing the at least one other ambient audio signal with the second directional transfer function pair.

20 Claims, 4 Drawing Sheets

(52) U.S. Cl.
CPC ..... *H04R 2430/20* (2013.01); *H04S 7/304* (2013.01); *H04S 2400/11* (2013.01); *H04S 2420/01* (2013.01)

(56) References Cited

U.S. PATENT DOCUMENTS

| | | | | |
|---|---|---|---|---|
| 2003/0007648 | A1* | 1/2003 | Currell | H04S 7/305 381/61 |
| 2004/0076301 | A1* | 4/2004 | Algazi | H04S 7/304 381/17 |
| 2008/0243278 | A1 | 10/2008 | Dalton et al. | 700/94 |
| 2010/0177910 | A1* | 7/2010 | Watanabe | H04R 5/033 381/94.1 |
| 2010/0290636 | A1 | 11/2010 | Mao et al. | 381/74 |
| 2011/0299707 | A1 | 12/2011 | Meyer | 381/310 |
| 2013/0064375 | A1 | 3/2013 | Atkins et al. | 381/17 |
| 2014/0328505 | A1* | 11/2014 | Heinemann | G06F 3/017 381/303 |
| 2015/0326963 | A1* | 11/2015 | Sorensen | H04R 1/1041 381/74 |
| 2016/0183024 | A1* | 6/2016 | Karkkainen | H04S 7/303 381/17 |

FOREIGN PATENT DOCUMENTS

| | | | |
|---|---|---|---|
| TW | 201215179 | A | 4/2012 |
| WO | WO-2014/036121 | A1 | 3/2014 |
| WO | WO-2014/111765 | A1 | 7/2014 |

* cited by examiner

APPARATUS, METHOD AND COMPUTER PROGRAM FOR PROVIDING SOUND REPRODUCTION

TECHNOLOGICAL FIELD

Examples of the disclosure relate to an apparatus, method and computer program for providing sound reproduction. In particular they relate to an apparatus, method and computer program for providing directional sound reproduction.

BACKGROUND

Spatial sound reproduction systems are designed to reproduce the perception of spatial aspects of a sound field. Spatial aspects of a sound field may comprise the direction, the distance and the size of the sound source as well as properties of the surrounding physical space or any other suitable aspect.

The spatial aspects of a sound field may be captured using a microphone array. The microphone array may comprise a plurality of spaced microphones. The captured signals are then converted into a form such that a listener experiences the sound as if they were hearing an original event.

It is useful to provide improved spatial sound reproduction systems.

BRIEF SUMMARY

According to various, but not necessarily all, examples of the disclosure there may be provided a method comprising: obtaining at least three ambient audio signals wherein at least one of the ambient audio signals is to be processed with a first directional transfer function pair and at least one other of the ambient audio signals is to be processed with a second directional transfer function pair wherein the directional transfer function pairs to be used are based on target directions of the ambient audio signals; determining a change of the target direction for the at least one ambient audio signal to an updated target direction; selecting an updated directional transfer function pair associated with the updated target direction wherein the updated directional transfer function pair is selected from a plurality of directional transfer functions and the updated directional transfer function pair is more closely associated with the updated target direction than the first directional transfer function pair; and processing the at least one ambient audio signal with the selected updated directional transfer function pair and processing the at least one other ambient audio signal with the second directional transfer function pair.

In some examples the second directional transfer function pair which is used for the at least one other ambient signal is not updated.

In some examples the first directional transfer function pair, the second directional transfer function pair and the updated directional transfer function pair may all be different.

In some examples processing the at least one ambient audio signal with the selected updated directional transfer function may comprise interpolating the first directional transfer function with the updated directional transfer function to gradually change the directional transfer function used.

In some examples the directional transfer functions may comprise head related transfer functions.

In some examples the ambient audio signals may be convolved with a filter.

In some examples more than three ambient audio signals may be obtained.

In some examples two or more of the ambient signals may be identical but may have unique target directions In some examples the determining of a change in target direction and selection of an updated directional transfer function pair is only performed for one ambient audio signal at a time.

In some examples the determining of a change in target direction and selection of an updated directional transfer function pair may be repeated for each of the ambient audio signals.

In some examples the ambient audio signal may comprise reverberant audio signals.

In some examples the ambient audio signals may be obtained by a plurality of spaced microphones.

In some examples the method may also comprise determining a magnitude of the change in target direction wherein if the magnitude is above a threshold the directional transfer function pair is changed and if the magnitude is below a threshold the directional transfer function pair is not changed.

In some examples the updated target direction may be determined in response to a user moving their head.

According to various, but not necessarily all, examples of the disclosure there may be provided an apparatus comprising: processing circuitry; and memory circuitry including computer program code, the memory circuitry and the computer program code configured to, with the processing circuitry, enable the apparatus to perform; obtaining at least three ambient audio signals wherein at least one of the ambient audio signals is to be processed with a first directional transfer function pair and at least one other of the ambient audio signals is to be processed with a second directional transfer function pair wherein the directional transfer function pairs to be used are based on target directions of the ambient audio signals; determining a change of the target direction for the at least one ambient audio signal to an updated target direction; selecting an updated directional transfer function pair associated with the updated target direction wherein the updated directional transfer function pair is selected from a plurality of directional transfer functions and the updated directional transfer function pair is more closely associated with the updated target direction than the first directional transfer function pair; and processing the at least one ambient audio signal with the selected updated directional transfer function pair and processing the at least one other ambient audio signal with the second directional transfer function pair.

In some examples the second directional transfer function pair which is used for the at least one other ambient signal is not updated.

In some examples the first directional transfer function pair, the second directional transfer function pair and the updated directional transfer function pair may all be different.

In some examples processing the at least one ambient audio signal with the selected updated directional transfer function may comprise interpolating the first directional transfer function with the updated directional transfer function to gradually change the directional transfer function used.

In some examples the directional transfer functions may comprise head related transfer functions.

In some examples the ambient audio signals may be convolved with a filter.

In some examples more than three ambient audio signals may be obtained.

In some examples two or more of the ambient signals may be identical but may have unique target directions In some examples the determining of a change in target direction and selection of an updated directional transfer function pair may only be performed for one ambient audio signal at a time.

In some examples the determining of a change in target direction and selection of an updated directional transfer function pair may be repeated for each of the ambient audio signals.

In some examples the ambient audio signal may comprise reverberant audio signals.

In some examples the ambient audio signals may be obtained by a plurality of spaced microphones.

In some examples the apparatus may be configured to determine a magnitude of the change in target direction wherein if the magnitude is above a threshold the directional transfer function pair is changed and if the magnitude is below a threshold the directional transfer function pair is not changed.

In some examples the updated target direction may be determined in response to a user moving their head.

According to various, but not necessarily all, examples of the disclosure there may be provided a computer program comprising computer program instructions that, when executed by processing circuitry, enable: obtaining at least three ambient audio signals wherein at least one of the ambient audio signals is to be processed with a first directional transfer function pair and at least one other of the ambient audio signals is to be processed with a second directional transfer function pair wherein the directional transfer function pairs to be used are based on target directions of the ambient audio signals; determining a change of the target direction for the at least one ambient audio signal to an updated target direction; selecting an updated directional transfer function pair associated with the updated target direction wherein the updated directional transfer function pair is selected from a plurality of directional transfer functions and the updated directional transfer function pair is more closely associated with the updated target direction than the first directional transfer function pair; and processing the at least one ambient audio signal with the selected updated directional transfer function pair and processing the at least one other ambient audio signal with the second directional transfer function pair.

In some examples there may be provided a computer program comprising program instructions for causing a computer to perform the methods described above.

In some examples there may be provided a physical entity embodying the computer programs as described above.

In some examples there may be provided an electromagnetic carrier signal carrying the computer program as described above.

According to various, but not necessarily all, examples of the disclosure there may be provided an apparatus comprising an audio reproduction application configured to enable; obtaining at least three ambient audio signals wherein at least one of the ambient audio signals is to be processed with a first directional transfer function pair and at least one other of the ambient audio signals is to be processed with a second directional transfer function pair wherein the directional transfer function pairs to be used are based on target directions of the ambient audio signals; determining a change of the target direction for the at least one ambient audio signal to an updated target direction; selecting an updated directional transfer function pair associated with the updated target direction wherein the updated directional transfer function pair is selected from a plurality of directional transfer functions and the updated directional transfer function pair is more closely associated with the updated target direction than the first directional transfer function pair; and processing the at least one ambient audio signal with the selected updated directional transfer function pair and processing the at least one other ambient audio signal with the second directional transfer function pair.

According to various, but not necessarily all, examples of the disclosure there may be provided an apparatus comprising; means for obtaining at least three ambient audio signals wherein at least one of the ambient audio signals is to be processed with a first directional transfer function pair and at least one other of the ambient audio signals is to be processed with a second directional transfer function pair wherein the directional transfer function pairs to be used are based on target directions of the ambient audio signals; means for determining a change of the target direction for the at least one ambient audio signal to an updated target direction; means for selecting an updated directional transfer function pair associated with the updated target direction wherein the updated directional transfer function pair is selected from a plurality of directional transfer functions and the updated directional transfer function pair is more closely associated with the updated target direction than the first directional transfer function pair; and means for processing the at least one ambient audio signal with the selected updated directional transfer function pair and processing the at least one other ambient audio signal with the second directional transfer function pair.

According to various, but not necessarily all, examples of the disclosure there is provided examples as claimed in the appended claims.

BRIEF DESCRIPTION

For a better understanding of various examples that are useful for understanding the detailed description, reference will now be made by way of example only to the accompanying drawings in which.

DETAILED DESCRIPTION

Figure 1:
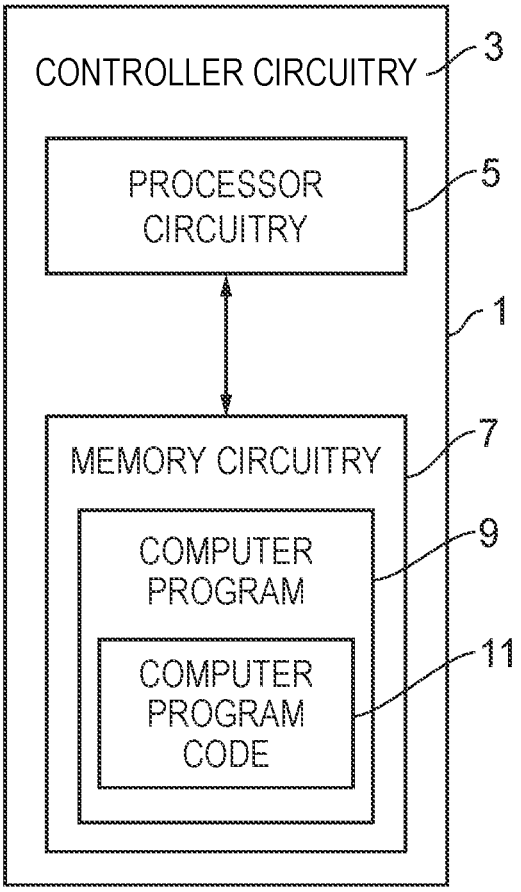
FIG. 1 illustrates an apparatus.

The Figures illustrate example methods, apparatus 1 and computer programs 9. The method comprises: obtaining 31 at least three ambient audio signals wherein at least one of the ambient audio signals is to be processed with a first directional transfer function pair and at least one other of the ambient audio signals is to be processed with a second directional transfer function pair wherein the directional transfer function pairs to be used are based on target directions of the ambient audio signals; determining 33 a change of the target direction for the at least one ambient audio signal to an updated target direction; selecting 35 an updated directional transfer function pair associated with the updated target direction wherein the updated directional transfer function pair is selected from a plurality of directional transfer functions and the updated directional transfer function pair is more closely associated with the updated target direction than the first directional transfer function pair; and processing 37 the at least one ambient audio signal with the selected updated directional transfer function pair and processing the at least one other ambient audio signal with the second directional transfer function pair.

The apparatus 1 may be for providing an audio signal. The apparatus 1 may be for providing a directional audio signal.

Examples of the disclosure may enable an audio signal to be adapted as a user moves their head so that the user experiences the sound as if they are hearing the original event. Examples of the disclosure may enable ambient sound signals to be adapted as the user moves their head. The movement of the head could comprise the rotation of the user's head. The rotation may be determined as a change in the aziumthal angle. In some examples the movement of the head could comprise a tilt or elevation or any other suitable movement. The tilt or elevation could be instead of, or in addition, to a rotation.

FIG. 1 schematically illustrates an example apparatus 1 which may be used in implementations of the disclosure. The apparatus 1 illustrated in FIG. 1 may be a chip or a chip-set. In some examples the apparatus 1 may be provided within a device 21 such as headphones or other wearable device. In some examples the apparatus 1 could be provided within a user electronic device such as mobile phone or other portable device and configured to provide a signal to headphones of other wearable devices.

The example apparatus 1 comprises controlling circuitry 3. The controlling circuitry 3 may provide means for controlling an electronic device. For instance, where the apparatus 1 is provided in a headphone or headset the controlling circuitry 3 may provide means for controlling the output of a loudspeaker. The controlling circuitry 3 may also provide means for performing the methods or at least part of the methods of examples of the disclosure.

The processing circuitry 5 may be configured to read from and write to memory circuitry 7. The processing circuitry 5 may comprise one or more processors. The processing circuitry 5 may also comprise an output interface via which data and/or commands are output by the processing circuitry 5 and an input interface via which data and/or commands are input to the processing circuitry 5.

The memory circuitry 7 may be configured to store a computer program 9 comprising computer program instructions (computer program code 11) that controls the operation of the apparatus 1 when loaded into processing circuitry 5. The computer program instructions, of the computer program 9, provide the logic and routines that enable the apparatus 1 to perform the example methods illustrated in FIGS. 3 and 4. The processing circuitry 5 by reading the memory circuitry 7 is able to load and execute the computer program 9. In some examples the computer program 9 may comprise an audio reproduction application. The audio reproduction application may be configured to enable example methods of the disclosure to be performed by an apparatus 1.

In some examples the computer program 9 may comprise an audio capture application. The audio capture application may be configured to enable an apparatus 1 to capture audio signals such as ambient audio signals which may be used in examples of the disclosure. In some examples the apparatus 1 may be configured to audio capture and audio reproduction.

The apparatus 1 therefore comprises: processing circuitry 5; and memory circuitry 7 including computer program code 11, the memory circuitry 7 and the computer program code 11 configured to, with the processing circuitry 5, cause the apparatus 1 at least to perform: obtaining 31 at least three ambient audio signals wherein at least one of the ambient audio signals is to be processed with a first directional transfer function pair and at least one other of the ambient audio signals is to be processed with a second directional transfer function pair wherein the directional transfer function pairs to be used are based on target directions of the ambient audio signals; determining 33 a change of the target direction for the at least one ambient audio signal to an updated target direction; selecting 35 an updated directional transfer function pair associated with the updated target direction wherein the updated directional transfer function pair is selected from a plurality of directional transfer functions and the updated directional transfer function pair is more closely associated with the updated target direction than the first directional transfer function pair; and processing 37 the at least one ambient audio signal with the selected updated directional transfer function pair and processing the at least one other ambient audio signal with the second directional transfer function pair.

The computer program 9 may arrive at the apparatus 1 via any suitable delivery mechanism. The delivery mechanism may be, for example, a non-transitory computer-readable storage medium, a computer program product, a memory device, a record medium such as a compact disc read-only memory (CD-ROM) or digital versatile disc (DVD), or an article of manufacture that tangibly embodies the computer program. The delivery mechanism may be a signal configured to reliably transfer the computer program 9. The apparatus may propagate or transmit the computer program 9 as a computer data signal. In some examples the computer program code 11 may be transmitted to the apparatus 1 using a wireless protocol such as Bluetooth, Bluetooth Low Energy, Bluetooth Smart, 6LoWPan ($IP_v6$ over low power personal area networks) ZigBee, ANT+, near field communication (NFC), Radio frequency identification, wireless local area network (wireless LAN) or any other suitable protocol.

Although the memory circuitry 7 is illustrated as a single component in the figures it is to be appreciated that it may be implemented as one or more separate components some or all of which may be integrated/removable and/or may provide permanent/semi-permanent/dynamic/cached storage.

Although the processing circuitry 5 is illustrated as a single component in the figures it is to be appreciated that it may be implemented as one or more separate components some or all of which may be integrated/removable.

References to "computer-readable storage medium", "computer program product", "tangibly embodied computer program" etc. or a "controller", "computer", "processor" etc. should be understood to encompass not only computers having different architectures such as single/multi-processor architectures, Reduced Instruction Set Computing (RISC) and sequential (Von Neumann)/parallel architectures but also specialized circuits such as field-programmable gate arrays (FPGA), application-specific integrated circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term "circuitry" refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of "circuitry" applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in a server, a cellular network device, or other network device.

Figure 2:
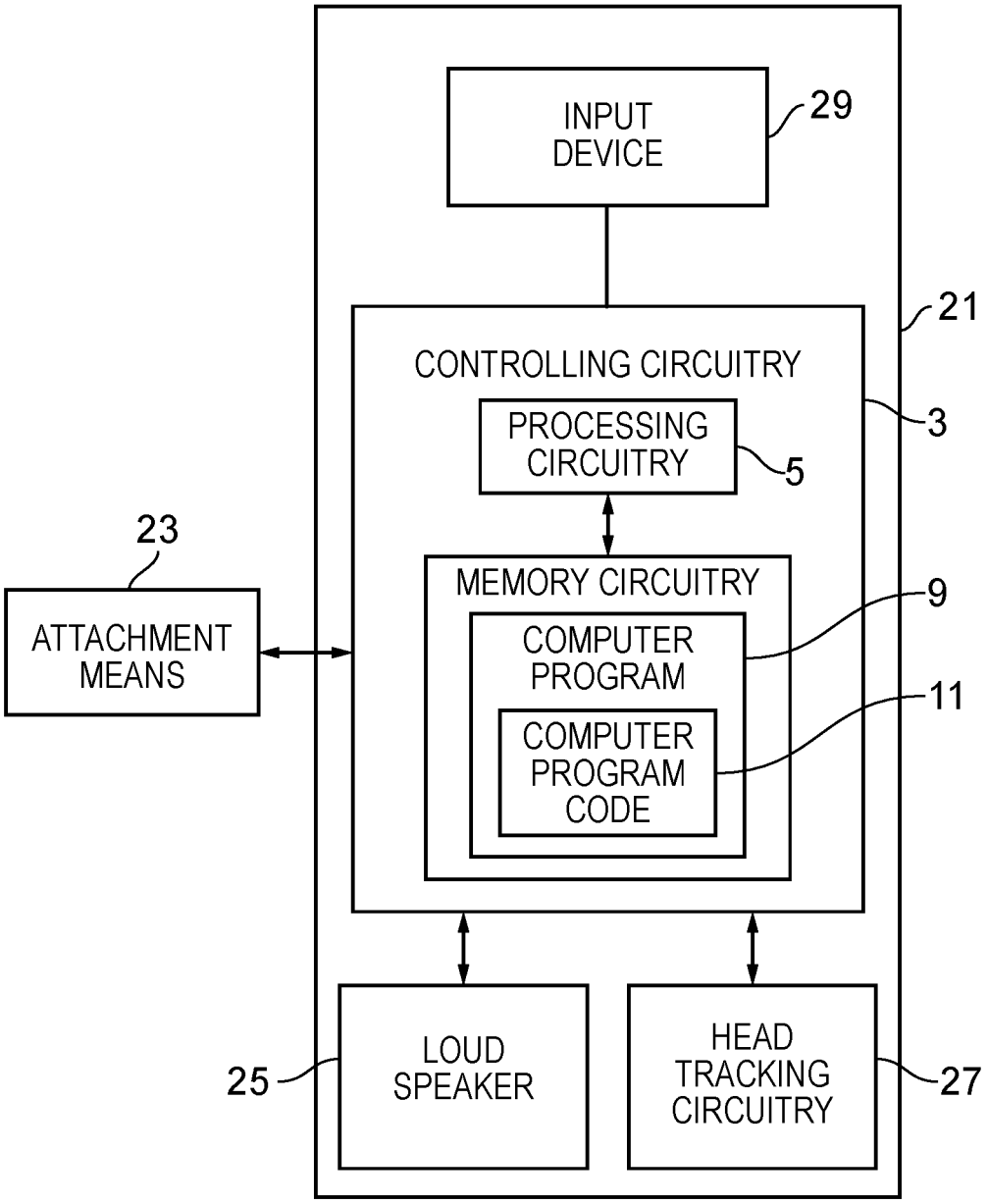
FIG. 2 illustrates an electronic device comprising an apparatus.

FIG. 2 schematically illustrates an electronic device 21. The electronic device 21 comprises an apparatus 1 as described above. Corresponding reference numerals are used for corresponding features. In addition to the apparatus 1 the example electronic device 21 of FIG. 1 also comprises attachment means 23, one or more loudspeakers 25, head tracking circuitry 27 and an input device 29. It is to be appreciated that only features which are needed for the following description are illustrated in FIG. 2. The electronic device 21 may comprise other features which are not illustrated in FIG. 2 such as a transceiver, a power source or any other suitable features.

The electronic device 21 may be headphones or a head set which is configured to be worn by the user. The attachment means 23 may comprise any means which enables the electronic device 21 to be worn by a user. The attachment means 23 may secure the electronic device 21 to the head of the user so that as the user moves their head the device 21 moves with their head. The attachment means 23 could comprise a head band, a strap or any other suitable means.

The loudspeaker 25 may provide a speaker element. The loudspeaker 25 may comprise any means which may be configured to convert an electrical input signal to an acoustic output signal. The loudspeaker 25 may be positioned within the electronic device 21 so that, in use, the loudspeaker 25 is positioned adjacent to the ear of the user. The electronic device 21 may be arranged so that as the user moves their head the loudspeaker 25 remains positioned adjacent to the user's ear.

The head tracking circuitry 27 may comprise any means which enables the position of the user's head to be monitored. The head tracking circuitry 27 may comprise motion sensing circuitry such as accelerometers, gyroscopic circuitry and/or any other suitable means.

The head tracking circuitry 27 may be configured to provide an input signal to the controlling circuitry 3. The input signal may comprise information indicative of the position of the user's head and/or a change in the position of the user's head. The head tracking circuitry 27 may be configured to detect rotation of the user's head and provide information indicative of the azimuthal angular position of the user's head. In some examples the head tracking circuitry 27 may be configured to detect other movements of a user's head such as tilting or elevating or any other suitable movement.

The input device 29 may comprise any means which may be configured to obtain ambient audio signals. The input device 29 may be configured to obtain a plurality of ambient audio signals. The input device 29 may be configured to obtain at least three ambient audio signals.

In some examples the input device 29 may comprise a receiver which may be configured to receive a signal comprising the ambient audio signals. In such examples the ambient audio signals may be captured by a microphone array at an external device. In some examples the input device 29 may comprise a spaced array of microphones within the device 21 or coupled to the device 21. In such examples the microphone array may be configured to capture the audio signals and enable the captured audio signals to be stored in the memory circuitry 7.

In some examples signals obtained by a spaced array of microphones may be processed to obtain the ambient audio signals. For instance, in some examples the audio signals captured by a spaced array of microphones may be processed to separate the ambient audio signals from the main components of the audio signal.

In other examples the ambient audio signals may comprise raw signals obtained by a spaced array of microphones. In such examples the main components of the audio signal may be captured using directional microphones and the ambient components could be captured using a spaced, omni-directional microphone array. The main components may be reproduced using any suitable methods such as conventional binaural techniques while the ambient components may be reproduced using examples of the disclosure such as the methods of FIGS. 3 and 4.

It is to be appreciated that any suitable combination of directional and/or omni-directional microphones may be used to capture the main components and the ambient components of the audio signals. Any combination of microphones may be configured to form suitable directional patterns. The microphones that capture the main components and the microphones that capture the ambient components may be omni-directional or directional independently of each other. The microphones that are used to capture the main components may be arranged to provide a first directional pattern and the microphones that are used to capture the ambient components are arranged to provide a second directional pattern.

In examples of the disclosure the ambient audio signals which are obtained by the input device 29 are rendered so as to enable, at least some degree, of the spatial aspects of the sound field to be perceived by the user. Each of the ambient audio signals may have a target direction. The ambient audio signals may be convolved or otherwise processed with directional transfer function pairs so that when the ambient audio signals are rendered the user perceives the correct target directions for the audio signals.

The target direction could be determined by the microphone which captured the ambient audio signal. For instance the target direction could be determined by the position of the microphone relative to a centre point, or any other suitable point, of the array. This may be the case in examples where the ambient audio signals comprises raw signals obtained by a spaced microphone array. In other examples the target directions may be determined by the processing of the captured audio signals.

In the example described above the electronic device 21 may be a headset. It is to be appreciated that the apparatus 1 could be provided in other types of electronic devices to enable the methods of the disclosure to be carried out. For instance, in some examples some or all of the blocks of the methods may be performed by a user device such as a mobile telephone or other portable electronic device. In such examples the electronic device 21 may comprise a transceiver to enable information to be exchanged between the headset and the user devices. In some examples there may be a communication connection between the headset and the electronic device 21. The connection could be a wired or wireless connection.

Figure 3:
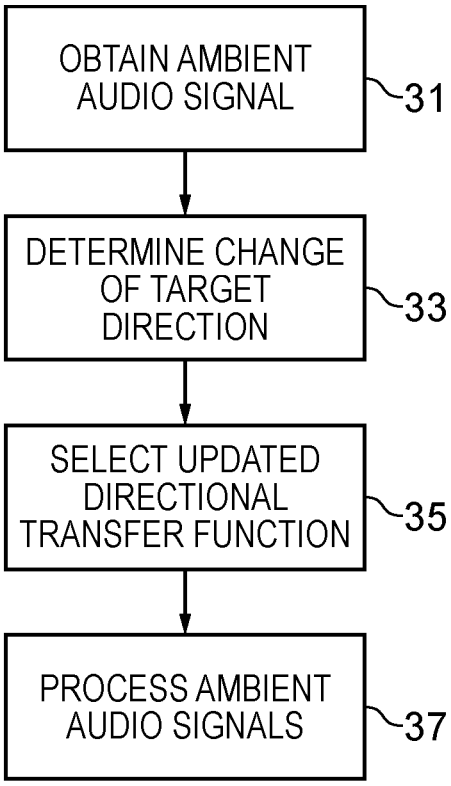
FIG. 3 illustrates a method.

FIG. 3 illustrates a method. The example method may be implemented using an apparatus 1 and electronic device 21 as described above. The method comprises, at block 31 obtaining at least three ambient audio signals wherein at least one of the ambient audio signals is to be processed with a first directional transfer function pair. At least one other of the ambient audio signals is to be processed with a second directional transfer function pair. The directional transfer function pairs to be used are based on target directions of the ambient audio signals.

At block 33 the method comprises determining a change of the target direction for the at least one ambient audio signal to an updated target direction.

At block 35 the method comprises selecting an updated directional transfer function pair associated with the updated target direction. The updated directional transfer function pair is selected from a plurality of directional transfer functions. The updated directional transfer function pair is more closely associated with the updated target direction than the first directional transfer function pair.

The method also comprises, at block 37 processing the at least one ambient audio signal with the selected updated directional transfer function pair and processing the at least one other ambient audio signal with the second directional transfer function pair.

Figure 4:
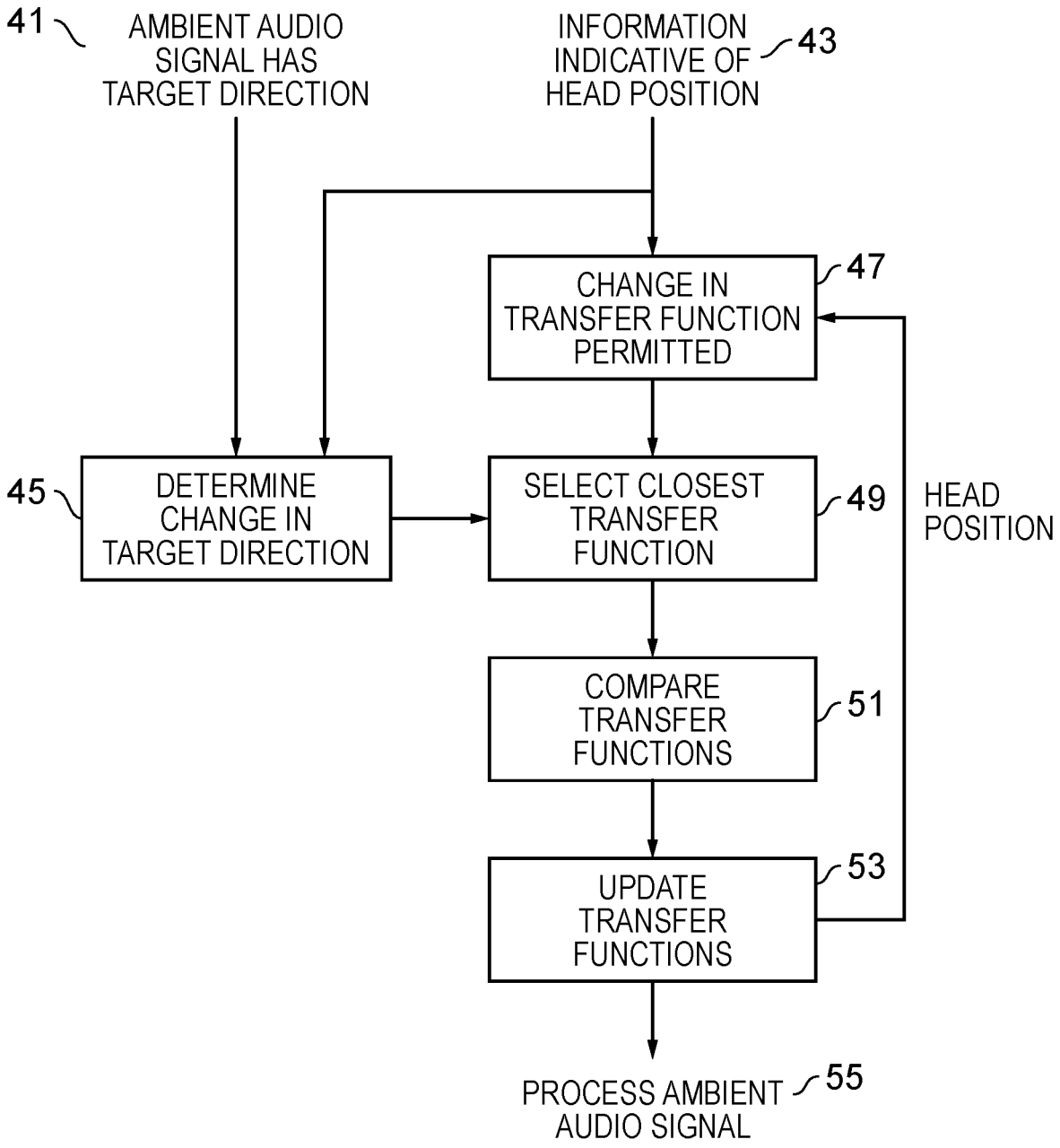
FIG. 4 illustrates another method.

FIG. 4 illustrates another example method which may be implemented with apparatus 1 and devices 21 such as those of FIGS. 1 and 2. The method of FIG. 4 gives an example of how a directional transfer function pair may be changed.

The example method of FIG. 4 may be applied to ambient audio signals. It is to be appreciated that both ambient audio signals and main audio signals may be obtained.

The ambient audio signals could be distinguished from the main signals so that the example methods are only applied to the ambient audio signals.

The ambient audio signals may be obtained by a plurality of spaced microphones. In some examples the signals captured by the microphones may be processed before the method of FIG. 4 is applied. In some examples the ambient audio signals may be captured by one or more remote devices and may be transmitted to the electronic device 21.

The example method of FIG. 4 is applied to one ambient audio signal at a time. In the example of FIG. 4 three or more ambient audio signals may be obtained but the method of FIG. 4 is only applied to one of the ambient audio signals at a time. It is to be appreciated that the method or similar methods could be applied to more than one signal at a time in other examples of the disclosure.

In some examples of the disclosure the method of FIG. 4 may be applied sequentially to each of the obtained ambient audio signals. The method may be applied sequentially so that only one ambient audio signal is changed at a time.

The ambient audio signals may comprise reverberant components. The ambient audio signals may comprise directional sound aspects. In order for the user to experience the sound as if they are hearing the original event the ambient audio signals need to be correlated with the position of the user's head. The ambient audio signals may need to be adapted if the user moves their head. Examples of the disclosure may be used to adapt the ambient audio signals if the user rotates or otherwise moves their head.

Each of the ambient audio signals has a target direction. The target direction defines the position of the source of the ambient audio signal as it should be perceived by the user. The target direction could be determined by the position of the microphone used to capture the ambient audio signal, by the processing used to separate the ambient audio signal from the main components of an audio signal or by any other suitable method.

The ambient audio signals are to be processed with directional transfer function pairs. The ambient audio signals may be convolved with directional transfer function pairs.

The directional function pairs that are to be used are based on the target directions of the ambient audio signals so that when a user hears the audio signals they perceive the sound as though it is coming from the target direction. The directional transfer function pair that is used to enable the user to perceive the correct target direction may depend on the position of the user's head. If the user rotates or otherwise moves their head then the directional transfer function pair needed to obtain the correct target direction may change.

The directional transfer function may comprise any function which may be used to process an ambient audio signal such that the user perceives spatial aspects of the ambient audio signal. In the example of FIG. 4 the directional transfer functions may comprise head-related transfer functions (HRTF). The HRTFs may be transfer functions which are measured in an anechoic chamber with the sound source at the desired direction and microphones positioned within an ear canal. It is to be appreciated that other methods may be used to obtain HRTFs.

Each HRFT may be associated with one ear. To enable an ambient audio signal to be perceived as though it originates from a target direction a HRTF pair may be used. The HRFT pair may comprise a first HRTF for the right ear and a second HRFT for the left ear. In such examples the directional transfer functions may comprise pairs of associated HRFTs. It is to be appreciated that in other examples of the disclosure other directional transfer functions may be used instead of or in addition to HRTFs.

In examples of the disclosure head tracking circuitry 27 may be configured to monitor the position of the user's head and provide input signals indicative of the user's head position. When the user moves their head this may change the target directions of the plurality of ambient audio signals. The ambient audio signals must be adapted so that the user still hears the sound as though they are hearing the original event.

FIG. 4 illustrates a method of adapting an ambient audio signal when a user moves their head. The ambient audio signal could be one of at least three ambient audio signals. The ambient audio signals may be obtained by an input device 29 as described above. Other numbers of ambient audio signals may be used in other examples of the disclosure.

At block 41 the ambient audio signal has a target direction. The ambient audio signal is to be processed with a first directional transfer function pair. The first directional transfer function pair enables a user to perceive the correct target direction for the ambient audio signal. The first directional transfer function pair may comprise a pair of HRTFs as described above or any other suitable transfer function. The first directional transfer function pair enables the user to perceive directional components of the ambient sound signal as though they are hearing the original sound event.

It is to be appreciated that three or more ambient audio signals may be obtained. The ambient audio signals which are not being updated in the method of FIG. 4 may also have target directions and may be arranged to be processed with directional transfer functions based on these target directions. In some examples each of the ambient audio signals may be processed with different directional transfer function pairs.

At block 43 the head tracking circuitry 27 provides information indicative of the current position of the user's head. In some examples the head tracking circuitry may provide information indicative of the orientation of the user's head. In the example of FIG. 4 the head tracking circuitry 27 provides information indicative of the azimuthal angle of the user's head.

It is to be appreciated that other methods of determining that a user has moved their head may be used in some examples of the disclosure. For instance, in some examples the user could make a manual input indicating the position of their head.

At block 45 a change in the target direction for the ambient audio signal is determined. The target direction may change to an updated target direction. The information obtained from the head tracking circuitry 27 may be used to determine the updated target direction.

At block 47 it is determined whether or not it is permitted to change the directional transfer function pair of the ambient audio signal. In some examples of the disclosure it may only be permitted to change the directional transfer function pair if the user has moved their head by a significant amount. The directional transfer function pair may be changed if the user has moved their head by a significant amount compared to the head position when the directional transfer function pair was last updated. For instance the change in directional transfer function pair might only be permitted if the user has rotated their head through a threshold angle.

At block 47 the controlling circuitry 3 may determine a magnitude of a change in the target direction. If the change in the target direction is above a threshold then the changing of the directional transfer function pair may be permitted and the method may proceed to blocks 49 to 53. If it is determined that the change in the target direction is below a threshold then the directional transfer function pair is not changed. This may prevent jumping back and forth between different directional transfer functions.

In examples of the disclosure it may only be permitted to change the directional transfer function pair for a limited number of the ambient audio signals at a time. At block 47 the controller circuitry 3 may check whether or not the directional transfer function pair has been changed for other ambient audio signals. If the directional transfer function pair has been changed for M ambient audio signals then it is not permitted to change the directional transfer function pair of the current ambient audio signal. M may have a number which is small compared to the number of ambient audio signals. In some examples M may be one so that only one ambient audio signal may be updated at a time.

If changing of the directional transfer function pair is permitted then, at block 49, an updated directional transfer function pair associated with the updated target direction is selected. The updated directional transfer function pair is more closely associated with the updated target direction than the first directional transfer function pair. The directional transfer function pair associated with the updated target direction may be the directional transfer function pair which can be used to process the ambient audio signal to enable the correct updated target direction to be perceived.

The updated directional transfer function pair may be selected from a plurality of directional transfer functions. The plurality of directional transfer functions may be stored in a database or table which may be accessed by the processor circuitry 5. In some examples the database or table may be stored remotely to the electronic device 21. In such examples the processor circuitry 5 may establish a communication connection with the remote device which stores the table and/or data base so as to enable the processor circuitry to access the table and/or database. The communication connection could be a wired or wireless connection. In other examples the table and/or database could be stored in the memory circuitry 7 of the electronic device 21.

The updated directional transfer function pair may be selected by computing the difference between the angular position of the directional transfer function pair and the updated target direction. The directional transfer function pair for which the difference in the angular position is the smallest may be determined to be the directional transfer function pair most closely associated with the updated target direction. The directional transfer function pair for which the angular position is the smallest maybe used to replace the first directional transfer function pair.

The difference between the angular position of the directional transfer function pair and the updated target direction may be computed for one or more angular directions. This may enable a change in orientation, elevation and tilt to be accounted for. In some examples the difference between the angular position of the directional transfer function pair and the updated target direction could be computed for only one direction.

For instance, in some examples only the rotation of the users head may be computed.

This may provide a simpler system which may still provide adequate sound reproduction for the ambient audio signals.

At block 51 the updated directional transfer function pair is compared to the first directional transfer function pair to determine if the updated directional transfer function pair is different to the first directional transfer function pair. If it is determined that the updated directional transfer function pair is different to the first directional function pair then the method may proceed to block 53.

If it is determined that the updated directional transfer function pair is the same as the first directional function pair then the directional transfer function pair does not need to be updated. For instance, if the user has moved only their head by a small amount then there might be no change in the directional transfer function pair to be used. As an example, if the user has rotated their head through an angle of five degrees this may change the target direction for the ambient audio signals. However as the target direction has only changed by a small amount the first directional transfer function pair may still be the closest directional transfer function pair. In such examples there would not need to be any update of the directional transfer function pair and the ambient audio signal could be processed with the first directional transfer function pair.

Similarly in some examples the updated directional transfer function pair could be substantially the same as the first directional function pair or similar to the first directional function pair. In such examples the directional transfer function pair does not need to be updated.

At block 53 the controlling circuitry 3 updates the directional transfer function pair so that the ambient audio signal is processed with the updated directional transfer function pair.

The directional transfer function pair may be updated using any suitable method. For instance, in some examples the ambient audio signal may first be convolved with a filter. The filter may provide the functionality of a decorrelator filter. In some examples the filters are decorrelators. The filter may make each of the plurality of ambient audio signals mutually incoherent. For instance two independent filters may provide two signals that are perceived as two incoherent signals when reproduced by a device such as an electronic device 21. The filtered signal may then be convolved with the directional transfer function corresponding to the target direction of the ambient audio signal.

At block 53, to change the directional transfer function pair, the controlling circuitry 3 may interpolate the first directional transfer function pair with the updated directional transfer function pair. The interpolation may enable the directional transfer function pair to be changed gradually.

In some examples cross fading may be applied between the two different directional transfer function pairs. In some examples the cross fading may be performed by multiplying convolved ambient audio signals with the following slopes $$g_{in}(n) = \sin^2\left(\frac{\pi n}{2N}\right)$$

$$g_{out}(n) = 1 - g_{in}(n)$$

where $g_{in}$ is the slope for the updated directional transfer function pair, $g_{out}$ is the slope for the first directional transfer function pair, and N is the length of the slope.

The length of the cross fading slope may be selected to avoid perceivable jumps between the different directional transfer functions pairs. The length of the cross fading slope used may depend on the gap between the different directional transfer functions pairs. In some examples the length of the cross fading slope could be of the order of 10 ms (e.g., 512 samples for 48 kHz signals, i.e., ~10 ms). In some examples the length of the cross fading slope may be kept short enough to avoid a perceivable delay in the change of the directional transfer function pairs.

At block 55 the ambient audio signal is processed with the updated directional transfer function pair.

At block 55 other audio signals may be processed with other directional transfer function pairs. The other audio signals may be the ambient audio signals that are not updated in the method of FIG. 4. These ambient audio signals are processed with the same directional transfer functions that were to be used at block 41. The directional transfer function pair is not updated for these signals.

The method may be repeated for the remaining signals of the other ambient audio signals that have not been updated. The method may be repeated if a further change in the user's head position is detected and/or after a time interval has elapsed.

It is to be appreciated that the method may comprise other blocks that are not illustrated in FIG. 4. For instance, in some examples information indicative of the current head position of the user may be saved so that it can be compared with future head positions of the user. This may enable further movement of the user's head to be monitored.

In the example of FIG. 4 at least three ambient audio signals are obtained and only one ambient audio signal is updated at a time. It is to be appreciated that different numbers of ambient audio signals could be used in different examples of the disclosure and also that, in some of these examples, more than one ambient audio signal could be updated at a time.

In other examples eight ambient audio signals may be obtained. In such examples only a small number of the ambient audio signals may be updated at a time. The number of signals that are updated at a time may be small enough so that the user does not perceive timbral changes when the signal is updated. The small number could be one.

In other examples a larger number of ambient audio signals could be obtained. For instance, in some examples twenty ambient audio signals could be obtained. In this example a small number of signals could be updated at any one time. The number of ambient audio signals that are updated could be small relative to the total number of available ambient audio signals. For instance where there are twenty ambient audio signals the small number of ambient audio signals could be between one and three inclusively.

Any number of directional transfer functions may be used in examples of the disclosure. The number of directional transfer functions may be designed to avoid large angle jumps between different directional transfer functions. The number of functions may be selected to avoid angular jumps greater than 90 degrees. This may prevent the user perceiving jumps when the directional transfer function pair is changed.

The directional transfer function pairs and the target directions may be selected so that only one ambient audio signal changes the directional transfer function pair at a time. In some examples this may be achieved by evenly distributing both the directional transfer function pairs and the target directions separately to each other in the azimuthal directions and making sure that the angles between adjacent directions are not multiples of each other.

If it is determined that two or more ambient audio signals require the directional transfer function pair to be changed at the same time then a first ambient audio signal may be updated in a first cycle and the other ambient audio signals may be updated in a different cycle.

It is to be appreciated that variations of the method of FIG. 4 may be used in examples of the disclosure. For instance, in the method of FIG. 4 determining a change in target direction at block 45 is only performed for one ambient audio signal. In other examples the change in target direction could be determined for all of the ambient audio signals. In such examples the updating of the directional transfer function pair would still only be performed for one, or a small number, of the audio signals.

In some examples each of the ambient audio signals that are obtained may be unique. Each of the ambient audio signals may be processed with a different transfer function pair. In other examples two or more of the ambient audio signals could be identical. In such examples all audio signals would still have different target directions and would be processed with different directional transfer function pairs.

In some examples one or more ambient audio signals may be processed with the same directional transfer function pair. For instance a first group of ambient audio signals could be processed with a first directional transfer function pair and a second group of ambient audio signals could be processed with a second directional transfer function pair. In such examples when the directional transfer function pair is updated it could be updated for the whole group of ambient audio signals or for just one or more signals within the group.

In the examples described above the target directions of the ambient audio signals may be predetermined. In other examples the electronic device 21 may be configured to process the ambient audio signals to determine the target direction. For instance in some examples the target direction may be a default direction which is updated when a user moves their head. In other examples signals other than the ambient audio signals could be used to determine the target direction of the ambient audio signals.

The example apparatus 1 and methods enable improved directional audio signals to be provided. The methods and apparatus 1 allow for the ambient components of the audio signals to be updated. This may be useful in applications such as virtual reality applications as it enables a user to perceive the sound as though they are hearing the original event. When a user moves their head the ambient audio signals are changed to account for the change in the position of the user's head relative to the sources of the sound signal.

Examples of the disclosure may help to avoid timbral effects which may be perceived by a user when directional components of the audio signal are updated as they rotate their head. In examples of the disclosure these effects are reduced because only one signal, or a small number of signals, is changed at a time.

By updating one, or a small number, of the plurality of ambient audio signals at a time the user does not perceive any jumping or sudden changes in the audio signal. This improves the quality of the sound signal that the user experiences.

In examples of the disclosure the ambient audio signals might only be updated if the user moves their head through a threshold angle. As the ambient audio signal is perceived as background to the main components of the audio signal the ambient components to do not need to be accurate or updated if the user only moves their head through a small angle. The examples of the disclosure allow the ambient audio signals to only be updated when necessary and so avoid unnecessary computations.

The blocks illustrated in the FIGS. 3 and 4 may represent steps in a method and/or sections of code in the computer program 9. The illustration of a particular order to the blocks does not necessarily imply that there is a required or preferred order for the blocks and the order and arrangement of the block may be varied. Furthermore, it may be possible for some blocks to be omitted.

The term "comprise" is used in this document with an inclusive not an exclusive meaning. That is any reference to X comprising Y indicates that X may comprise only one Y or may comprise more than one Y. If it is intended to use "comprise" with an exclusive meaning then it will be made clear in the context by referring to "comprising only one . . . " or by using "consisting".

In this brief description, reference has been made to various examples. The description of features or functions in relation to an example indicates that those features or functions are present in that example. The use of the term "example" or "for example" or "may" in the text denotes, whether explicitly stated or not, that such features or functions are present in at least the described example, whether described as an example or not, and that they can be, but are not necessarily, present in some of or all other examples. Thus "example", "for example" or "may" refers to a particular instance in a class of examples. A property of the instance can be a property of only that instance or a property of the class or a property of a sub-class of the class that includes some but not all of the instances in the class. It is therefore implicitly disclosed that a features described with reference to one example but not with reference to another example, can where possible be used in that other example but does not necessarily have to be used in that other example.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A method comprising:

obtaining at least three ambient audio signals, wherein at least one of the at least three ambient audio signals is processed with a first directional transfer function pair and at least one other of the at least three ambient audio signals is to be processed with a second directional transfer function pair, wherein the first directional transfer function pair is based on a target direction for the at least one ambient audio signal and the second directional transfer function pair is based on a target direction for the at least one other ambient audio signal;

determining a change of the target direction for the at least one ambient audio signal to an updated target direction;

selecting an updated directional transfer function pair associated with the updated target direction wherein the updated directional transfer function pair is selected from a plurality of directional transfer functions and the updated directional transfer function pair is better associated with the updated target direction than the first directional transfer function pair;

determining whether the updated directional transfer function pair is different from the first directional transfer function pair; and based on a determination that the updated directional transfer function pair is at least partially different from the first directional transfer function pair, processing the at least one ambient audio signal with the selected updated directional transfer function pair and processing the at least one other ambient audio signal with the second directional transfer function pair, wherein the second directional transfer function pair which is used for the at least one other ambient audio signal is not updated.

2. A method as claimed in claim 1, wherein the first directional transfer function pair, the second directional transfer function pair and the updated directional transfer function pair are all different.

3. A method as claimed in claim 1, wherein processing the at least one ambient audio signal with the selected updated directional transfer function pair comprises interpolating the first directional transfer function pair with the updated directional transfer function pair to gradually change a directional transfer function pair used for processing the at least one ambient audio signal.

4. A method as claimed in claim 1, wherein the first, second and updated directional transfer function pairs comprise head related transfer function pairs.

5. A method as claimed in claim 1, wherein the at least three ambient audio signals are convolved with a filter.

6. A method as claimed in claim 1, wherein two or more of the at least three ambient audio signals are identical ambient audio signals, wherein the ambient audio signals of the two or more ambient audio signals has a respective unique target direction.

7. A method as claimed in claim 1, wherein the determining of the change in the target direction and the selecting of the updated directional transfer function pair are performed for one ambient audio signal of the at least three ambient audio signals at a time.

8. A method as claimed in claim 1, wherein the determining of the change in the target direction and the selecting of the updated directional transfer function pair are repeated for the respective ambient audio signals of the at least three ambient audio signals.

9. A method as claimed in claim 1, wherein the at least three ambient audio signals comprises reverberant audio signals.

10. A method as claimed in claim 1, wherein the at least three ambient audio signals are obtained with a plurality of spaced microphones.

11. A method comprising:

obtaining at least three ambient audio signals, wherein at least one of the at least three ambient audio signals is processed with a first directional transfer function pair and at least one other of the at least three ambient audio signals is to be processed with a second directional transfer function pair, wherein the first directional transfer function pair is based on a target direction for the at least one ambient audio signal and the second directional transfer function pair is based on a target direction for the at least one other ambient audio signal;

determining a change of the target direction for the at least one ambient audio signal to an updated target direction;

determining a magnitude of the change of the target direction, and wherein the magnitude is above a threshold, the first directional transfer function pair is changed, and wherein the magnitude is below the threshold, the first directional transfer function pair is not changed;

selecting an updated directional transfer function pair associated with the updated target direction wherein the updated directional transfer function pair is selected from a plurality of directional transfer functions and the updated directional transfer function pair is better associated with the updated target direction than the first directional transfer function pair;

determining whether the updated directional transfer function pair is different from the first directional transfer function pair; and based on a determination that the updated directional transfer function pair is at least partially different from the first directional transfer function pair, processing the at least one ambient audio signal with the selected updated directional transfer function pair and processing the at least one other ambient audio signal with the second directional transfer function pair.

12. A method as claimed in claim 1, wherein the updated target direction is determined in response to a user moving their head.

13. An apparatus comprising:

processing circuitry; and non-transitory memory circuitry including computer program code, the non-transitory memory circuitry and the computer program code configured to, with the processing circuitry, enable the apparatus to perform:

obtaining at least three ambient audio signals, wherein at least one of the at least three ambient audio signals is processed with a first directional transfer function pair and at least one other of the at least three ambient audio signals is to be processed with a second directional transfer function pair, wherein the first directional transfer function pair is based on a target direction for the at least one ambient audio signal and the second directional transfer function pair is based on a target direction for the at least one other ambient audio signal;

determining a change of the target direction for the at least one ambient audio signal to an updated target direction;

selecting an updated directional transfer function pair associated with the updated target direction wherein the updated directional transfer function pair is selected from a plurality of directional transfer functions and the updated directional transfer function pair is better associated with the updated target direction than the first directional transfer function pair;

determining whether the updated directional transfer function pair is different from the first directional transfer function pair; and based on a determination that the updated directional transfer function pair is at least partially different from the first directional transfer function pair, processing the at least one ambient audio signal with the selected updated directional transfer function pair and processing the at least one other ambient audio signal with the second directional transfer function pair, wherein the second directional transfer function pair which is used for the at least one other ambient audio signal is not updated.

14. An apparatus as claimed in claim 13, wherein the first directional transfer function pair, the second directional transfer function pair and the updated directional transfer function pair are all different.

15. An apparatus as claimed in claim 13, wherein processing the at least one ambient audio signal with the selected updated directional transfer function pair comprises interpolating the first directional transfer function pair with the updated directional transfer function pair to gradually change a directional transfer function pair used for processing the at least one ambient audio signal.

16. An apparatus as claimed in claim 13, wherein the first, second and updated directional transfer function pairs comprise head related transfer function pairs.

17. An apparatus as claimed in claim 13, wherein two or more of the at least three ambient audio signals are at least one of:

convolved with a filter; or identical ambient audio signals, wherein the ambient audio signals of the two or more ambient audio signals has a respective unique target direction.

18. An apparatus as claimed in claim 13, wherein the determining of the change in the target direction and the selecting of the updated directional transfer function pair are performed for one ambient audio signal of the at least three ambient audio signals at a time.

19. A method as claimed in claim 11, wherein the first, second and updated directional transfer function pairs comprise head related transfer function pairs.

20. A method as claimed in claim 11, wherein the determining of the change in the target direction and the selecting of the updated directional transfer function pair are performed for one ambient audio signal of the at least three ambient audio signals at a time.

* * * * *